US009213254B2

(12) United States Patent
Wakamatsu

(10) Patent No.: US 9,213,254 B2
(45) Date of Patent: Dec. 15, 2015

(54) IMAGE FORMING APPARATUS

(71) Applicant: Brother Kogyo Kabushiki Kaisha, Nagoya-shi, Aichi-ken (JP)

(72) Inventor: Mayu Wakamatsu, Tsushima (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/525,314

(22) Filed: Oct. 28, 2014

(65) Prior Publication Data

US 2015/0117888 A1 Apr. 30, 2015

(30) Foreign Application Priority Data

Oct. 28, 2013 (JP) ..... 2013-223205

(51) Int. Cl.

| | |
|---|---|
| ***G03G 21/10*** | (2006.01) |
| ***G03G 15/06*** | (2006.01) |
| ***G03G 21/00*** | (2006.01) |
| ***G03G 15/00*** | (2006.01) |

(52) U.S. Cl.

CPC ..... *G03G 15/065* (2013.01); *G03G 15/5004* (2013.01); *G03G 21/0035* (2013.01); *G03G 2215/1661* (2013.01)

(58) Field of Classification Search

CPC ..... G03G 21/0076; G03G 2215/1661; G03G 2221/0057

USPC ..... 399/354, 358, 71

See application file for complete search history.

(56) References Cited

U.S. PATENT DOCUMENTS

| | | | | |
|---|---|---|---|---|
| 7,242,887 | B2 * | 7/2007 | Takeuchi et al. | 399/101 |
| 7,917,047 | B2 * | 3/2011 | Takishita | 399/49 |
| 8,204,392 | B2 * | 6/2012 | Okano | 399/27 |
| 8,224,213 | B2 * | 7/2012 | Takemoto | 399/254 |
| 8,644,723 | B2 * | 2/2014 | Shibuya et al. | 399/71 |
| 9,081,346 | B2 * | 7/2015 | Miyahara | G03G 15/55 |
| 2010/0209157 | A1 * | 8/2010 | Sato et al. | 399/343 |

FOREIGN PATENT DOCUMENTS

| | | | |
|---|---|---|---|
| JP | 11219040 A | * | 8/1999 |
| JP | 2003-091146 A | | 3/2003 |

* cited by examiner

*Primary Examiner* — Clayton E Laballe
*Assistant Examiner* — Leon W. Rhodes, Jr.
(74) *Attorney, Agent, or Firm* — Banner & Witcoff, Ltd.

(57) ABSTRACT

An image forming apparatus includes image carriers, holding rollers configured to hold developer attached on the respective image carriers, a belt having a surface which contacts the image carriers and moves in a moving direction, transfer members which transfer the developer on the respective image carriers to the belt, a collection device which collects the developer on the belt, and a control device which executes a cleaning control of causing the developer held on the holding rollers to be moved to the image carriers and the collection device to collect the developer via the image carriers and the belt. The control device starts the cleaning control, suspends the cleaning control before the developer moved to an image carrier from the holding roller positioned at a most downstream side in the moving direction reaches the collection device, and resumes the suspended cleaning control at a next printing preparation control.

20 Claims, 12 Drawing Sheets

IMAGE FORMING APPARATUS

CROSS-REFERENCE TO RELATED APPLICATION

This application claims priority from Japanese Patent Application No. 2013-223205, filed on Oct. 28, 2013, the entire subject matter of which is incorporated herein by reference.

TECHNICAL FIELD

Aspects of the present invention relate to an image forming apparatus configured to execute a cleaning control of collecting developer on a holding roller into a collection device via an image carrier and a belt.

BACKGROUND

There has been known an image forming apparatus which includes a plurality of photosensitive drums configured to carry thereon toner images, a plurality of charging rollers configured to contact the photosensitive drums and to charge the photosensitive drums, respectively, an intermediate transfer belt configured to contact the respective photosensitive drums and to which the toner images are transferred from the respective photosensitive drums, and a cleaning device configured to collect the toners on the intermediate transfer belt (refer to JP-A-2003-91146). Specifically, in this image forming apparatus, after a printing control is finished, a cleaning control of collecting the toners attached on the charging rollers into the collection device via the photosensitive drums and the intermediate transfer belt is executed.

However, in this image forming apparatus, it takes time to move the toners on the charging rollers to the cleaning device after the printing control is finished. Therefore, it takes time to execute the cleaning control after the printing control.

SUMMARY

Accordingly, it is an aspect of the present invention to shorten time necessary to execute a cleaning control after a printing control.

According to an illustrative embodiment of the present invention, there is provided an image forming apparatus including a plurality of image carriers configured to carry thereon developer images, respectively, a plurality of holding rollers provided to correspond to the plurality of image carriers and configured to hold developer attached on the respective image carriers, a rotatable endless belt having a surface configured to contact the plurality of image carriers and configured to move in a moving direction, a plurality of transfer members provided to interpose the belt between the respective image carriers and the respective transfer members and configured to transfer the developer on the respective image carriers to the belt, a collection device configured to contact the belt and to collect the developer on the belt, and a control device configured to execute a printing preparation control of rotating the respective image carriers, the respective holding rollers and the belt, a printing control of transferring the developer images on the image carriers to a sheet after the printing preparation control, a holding control of applying to the holding rollers a holding bias having a polarity opposite to the developer during the printing control such that the holding rollers hold the developer on the image carriers, and a cleaning control of applying to the holding rollers a discharge bias having a polarity same as the developer and applying to the transfer members a transfer bias having a polarity opposite to the developer such that the developer held on the holding rollers is moved to the image carriers and the collection device collects the developer via the image carriers and the belt. The control device is configured to start the cleaning control after the printing control, suspend the cleaning control before the developer moved to one of the image carriers from one of the holding rollers positioned at a most downstream side in the moving direction reaches the collection device, and resume the suspended cleaning control at a next printing preparation control.

According to another illustrative embodiment of the present invention, there is provided a control method for an image forming apparatus including a plurality of image carriers configured to carry thereon developer images, respectively, a plurality of holding rollers provided to correspond to the plurality of image carriers and configured to hold developer attached on the respective image carriers, a rotatable endless belt having a surface configured to contact the plurality of image carriers and configured to move in a moving direction, a plurality of transfer members provided to interpose the belt between the respective image carriers and the respective transfer members and configured to transfer the developer on the respective image carriers to the belt; a collection device configured to contact the belt and to collect the developer on the belt. The control method includes executing a printing preparation control of rotating the respective image carriers, the respective holding rollers and the belt, executing a printing control of transferring the developer images on the image carriers to a sheet after the printing preparation control, executing a holding control of applying to the holding rollers a holding bias having a polarity opposite to the developer during the printing control such that the holding rollers hold the developer on the image carriers, and executing a cleaning control of applying to the holding rollers a discharge bias having a polarity same as the developer and applying to the transfer members a transfer bias having a polarity opposite to the developer such that the developer held on the holding rollers is moved to the image carriers and the collection device collects the developer via the image carriers and the belt. The control method includes starting the cleaning control after the printing control, suspending the cleaning control before the developer moved to one of the image carriers from one of the holding rollers positioned at a most downstream side in the moving direction reaches the collection device, and resuming the suspended cleaning control at a next printing preparation control.

According to the above configuration, it is possible to shorten the time necessary to execute the cleaning control after the printing control.

BRIEF DESCRIPTION OF THE DRAWINGS

The above and other aspects of the present invention will become more apparent and more readily appreciated from the following description of illustrative embodiments of the present invention taken in conjunction with the attached drawings.

DETAILED DESCRIPTION

Hereinafter, an illustrative embodiment of the present invention will be described in detail with reference to the drawings. In the below descriptions, the directions are described on the basis of a user who uses a color printer (an example of an image forming apparatus). That is, the left of FIG. 1 is referred to as the 'front side,' the right of FIG. 1 is referred to as the 'rear side,' the back side of FIG. 1 is referred to as the 'left side' and the front side of FIG. 1 is referred to as the 'right side.' Also, the upper and lower directions of FIG. 1 are referred to as the 'upper-lower direction.'

Figure 1:
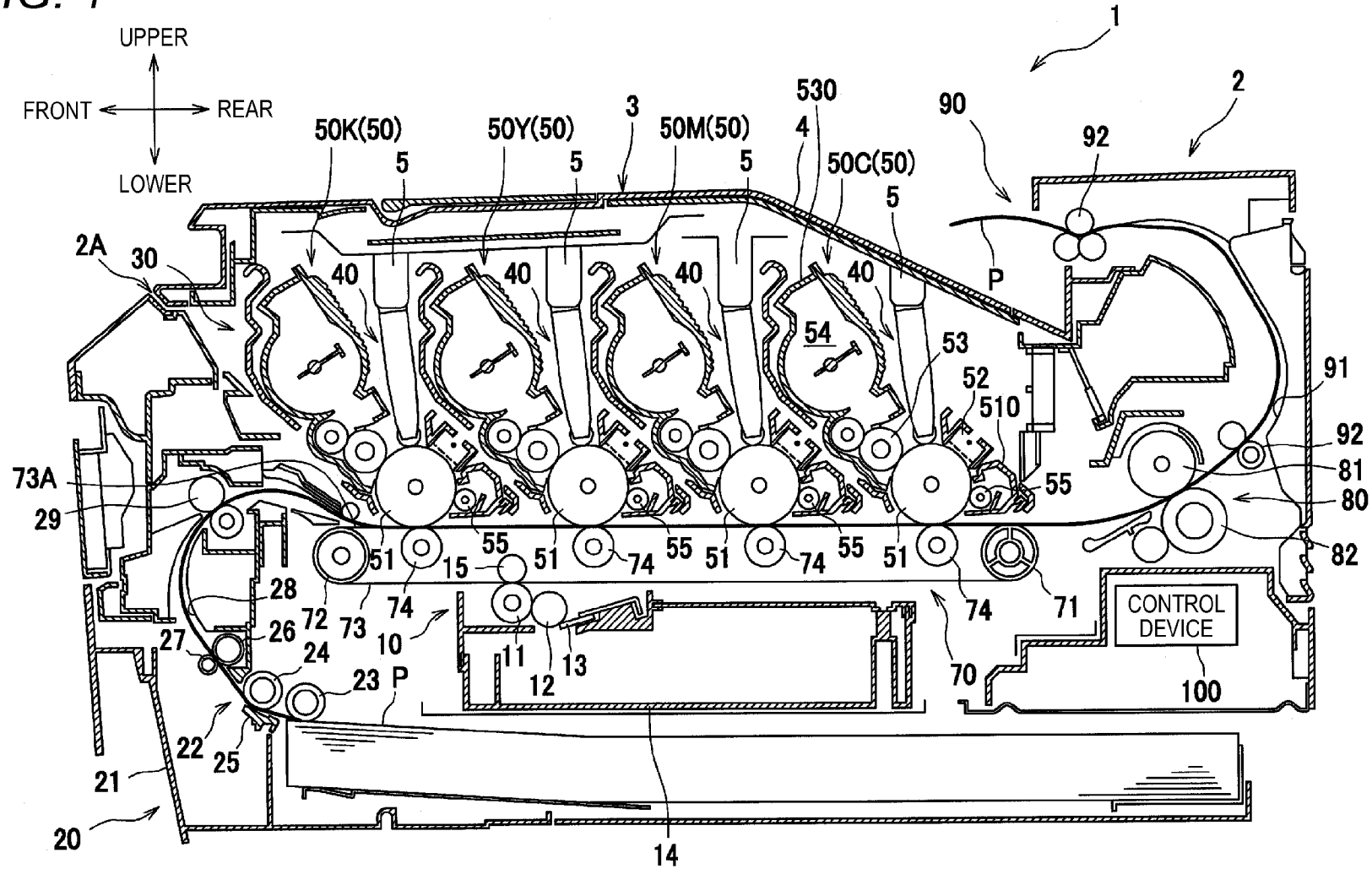
FIG. 1 is a sectional view showing a color printer according to an illustrative embodiment of the present invention.

As shown in FIG. 1, a color printer 1 has, in an apparatus main body 2, a feeder unit 20 configured to feed a sheet P (an example of a sheet), an image forming unit 30 configured to form an image on the fed sheet P, a sheet discharge unit 90 configured to discharge the sheet P having an image formed thereon, and a control device 100.

The apparatus main body 2 is formed at its upper part with an opening 2A. The opening 2A is opened and closed by an upper cover 3 rotatably supported to the apparatus main body 2. An upper surface of the upper cover 3 is a sheet discharge tray 4 on which the sheet P discharged from the apparatus main body 2 is accumulated, and a lower surface thereof is provided with a plurality of LED attaching members 5 configured to hold LED units 40.

The feeder unit 20 is provided at a lower part in the apparatus main body 2 and includes a sheet feeding tray 21 detachably mounted to the apparatus main body 2 and a sheet feeding mechanism 22 configured to convey the sheet P from the sheet feeding tray 21 towards the image forming unit 30. The sheet feeding mechanism 22 is provided in front of the sheet feeding tray 21 and includes a sheet feeding roller 23, a separation roller 24, a separation pad 25, a sheet dust collection roller 26, a pinch roller 27 and a registration roller 29.

In the feeder unit 20, the sheets P fed from the sheet feeding tray 21 by the sheet feeding roller 23 are separated by the separation roller 24 and the separation pad 25 one by one, which is then conveyed to the upper, and the sheet dusts are removed while the sheet passes between the sheet dust collection roller 26 and the pinch roller 27. After that, the direction of the sheet P is changed through a conveyance path 28 to direct rearward, the skew of the sheet P is corrected by the registration rollers 29, and then, the sheet P is fed to the image forming unit 30.

The image forming unit 30 has four LED units 40, four process cartridges 50, a transfer unit 70, a cleaning device 10 (an example of a collection device), and a fixing device 80.

The LED unit 40 is swingably coupled to the LED attaching member 5 and is appropriately positioned and supported by a positioning member provided for the apparatus main body 2.

The process cartridges 50 are arranged side by side in the front-rear direction between the upper cover 3 and the feeder unit 20, and have a drum cartridge 510 and a developing cartridge 530 (an example of a developing device), respectively. The drum cartridge 510 has a photosensitive drum 51 (an example of an image carrier), a charger 52 and a cleaning roller 55 (an example of a holding roller). The developing cartridge 530 is detachably mounted to the drum cartridge 510 and has a developing roller 53 and a toner accommodation chamber 54 configured to accommodate therein toner (an example of developer).

The process cartridges 50 are arranged side by side from an upstream side of a conveyance direction (a moving direction of a surface) of the sheet P in order of the process cartridges 50K, 50Y, 50M, 50C in which black, yellow, magenta and cyan toners are respectively accommodated. Meanwhile, in the specification and drawings, when specifying the photosensitive drum 51, the developing roller 53, the cleaning roller 55 and the like corresponding to the color of the toner, the reference signs K, Y, M, C are respectively attached in correspondence to black, yellow, magenta and cyan.

The photosensitive drums 51 are respectively provided for the plurality of drum cartridges 510 and are arranged side by side in the front-rear direction.

The developing roller 53 is configured to contact the photosensitive drum 51 and to supply the toner to an electrostatic latent image on the photosensitive drum 51. Incidentally, in this illustrative embodiment, when supplying the toner from the developing roller 53 to the photosensitive drum 51, the toner is sliding-contacted between the developing roller 53 and a supply roller (a reference numeral thereof is omitted), so that the toner is positively charged.

Figure 2:
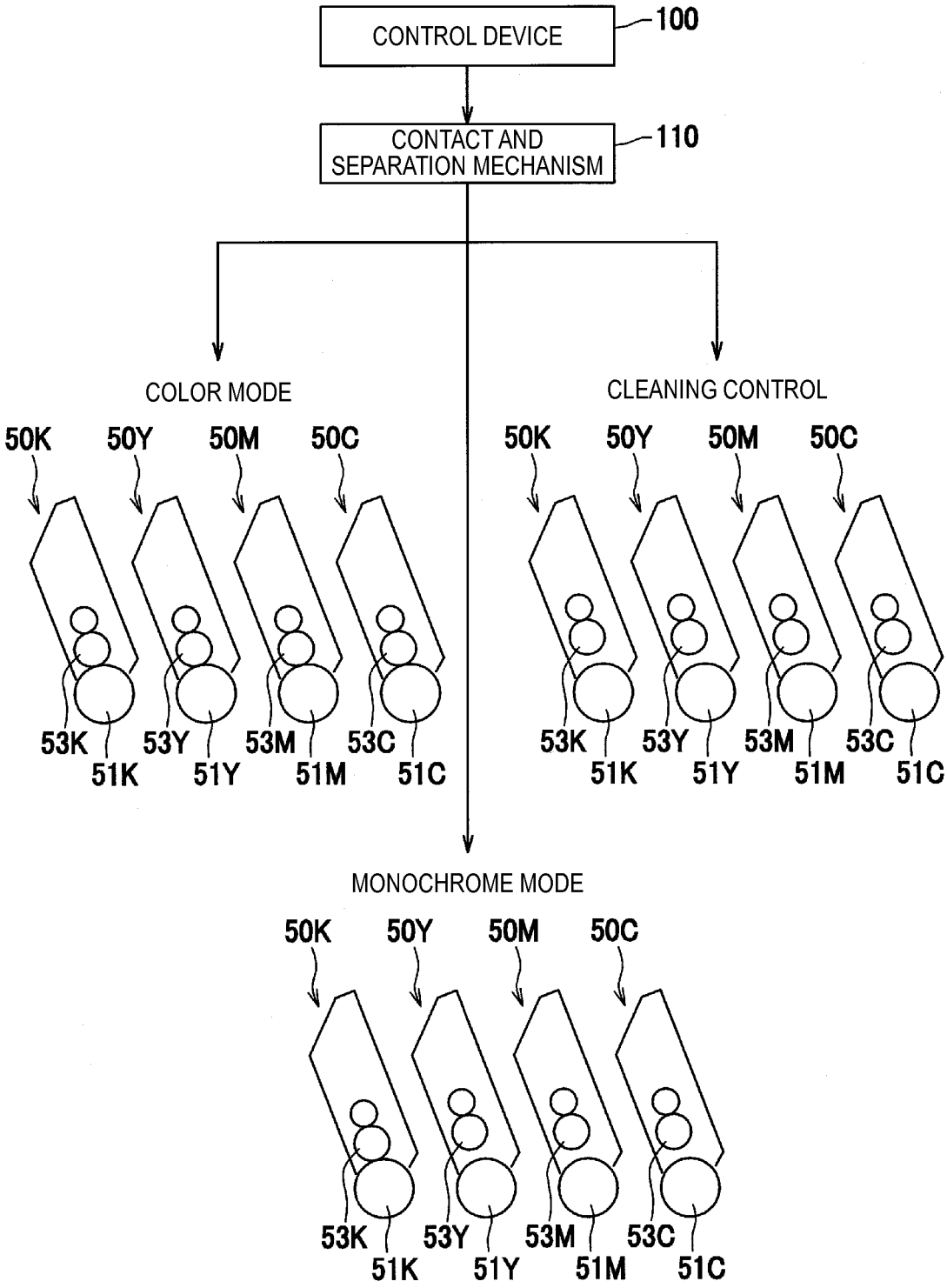
FIG. 2 shows separation states between photosensitive drums and developing rollers.

As shown in FIG. 2, the developing roller 53 is caused to come close to and to separate from the photosensitive drum 51 by controlling a contact and separation mechanism 110 with the control device 100. Specifically, in a color mode, all the developing rollers 53K, 53Y, 53M, 53C are contacted to the corresponding photosensitive drums 51K, 51Y, 51M, 51C to supply the toners to the respective photosensitive drums 51K, 51Y, 51M, 51C. In a monochrome mode, only the developing roller 53K for black (for monochrome) is contacted to the photosensitive drum 51K, and the other developing rollers 53Y, 53M, 53C are separated from the corresponding photosensitive drums 51Y, 51M, 51C. Further, in a cleaning control which will be described later, all the developing rollers 53K, 53Y, 53M, 53C are separated from the corresponding photosensitive drums 51K, 51Y, 51M, 51C.

As shown in FIG. 1, the plurality of cleaning rollers 55 are provided in the vicinity of the respective photosensitive drums 51 so as to correspond to the respective photosensitive drums 51. The cleaning roller 55 is configured so that a holding bias having an opposite polarity to the toner is applied thereto and the toner attached on the photosensitive drum 51 can be thus temporarily held with the cleaning roller 55. Also, the cleaning roller 55 is configured so that a discharge bias having the same polarity as the toner is applied thereto and the toner held by the cleaning roller 55 can be thus discharged (moved) to the photosensitive drum 51.

Also, a circumferential speed of the cleaning roller 55 is set to be faster than that of the photosensitive drum 51. Thereby, for example, as compared to a configuration where the circumferential speed of the cleaning roller is slower than that of the photosensitive drum, a discharged amount of the toner per unit time discharged from the cleaning roller 55 to the photosensitive drum 51 is increased, so that it is possible to shorten the time necessary to execute the cleaning control, which will be described later.

The transfer unit 70 is provided between the feeder unit 20 and the respective process cartridges 50, and has a driving roller 71, a driven roller 72, a conveyance belt 73 and transfer rollers 74 (an example of a transfer member).

The driving roller 71 and the driven roller 72 are arranged in parallel with being spaced from each other in the front-rear direction, and the conveyance belt 73 configured by an endless belt is wound around the driving roller 71 and the driven roller 72. The conveyance belt 73 has, as an outer surface, a surface 73A (facing surface) configured to face and contact the respective photosensitive drums 51, and is configured to rotate by the driving roller 71 so that the surface 73A moves along the arrangement direction of the respective photosensitive drums 51. Also, the four transfer rollers 74 configured to interpose the conveyance belt 73 between the respective photosensitive drums 51 and the transfer rollers 74 are arranged to face the respective photosensitive drums 51 at an inner side of the conveyance belt 73. A transfer bias is applied to the transfer rollers 74 at the transfer by a constant current control.

The cleaning device 10 is configured to sliding-contact the conveyance belt 73 and to collect the toner and the like attached on the conveyance belt 73 and is arranged to face the conveyance belt 73 at the lower of the conveyance belt 73. Specifically, the cleaning device 10 is configured to collect the toner on the cleaning rollers 55 via the photosensitive drums 51 and the conveyance belt 73. Specifically, the cleaning device 10 has a sliding-contact roller 11, a collection roller 12, a blade 13 and a waste toner chamber 14.

The sliding-contact roller 11 is arranged to contact an outer periphery of the conveyance belt 73 and is configured to collect the attachments on the conveyance belt 73 while a collection bias is applied between the sliding-contact roller 11 and a backup roller 15 arranged on an inner periphery of the conveyance belt 73.

The collection roller 12 is configured to sliding-contact the sliding-contact roller 11, and is configured to collect the attachments attached on the sliding-contact roller 11. The attachments on the collection roller 12 are scraped by the blade 13 arranged to sliding-contact the collection roller 12 and are collected into the waste toner chamber 14.

The fixing unit 80 is arranged at the rear side of the respective process cartridges 50 and the transfer unit 70, and has a heating roller 81 and a pressing roller 82 arranged to face the heating roller 81 and configured to press the heating roller 81.

In the image forming unit 30 configured as described above, the surface of each photosensitive drum 51 is uniformly positively charged by the charger 52 and is then exposed by each LED unit 40, in the color mode. Thereby, a potential of the exposed part are lowered, so that an electrostatic latent image based on image data is formed on each photosensitive drum 51. After that, the positively-charged toner is supplied to the electrostatic latent image from the developing roller 53, so that a toner image is carried on the photosensitive drum 51.

Then, the sheet P fed onto the conveyance belt 73 passes between the respective photosensitive drums 51 and the respective transfer rollers 74 arranged at the inner side of the conveyance belt 73, so that the toner images formed on the respective photosensitive drums 51 are transferred onto the sheet P. Then, the sheet P passes between the heating roller 81 and the pressing roller 82, so that the toner images transferred on the sheet P are heat-fixed.

The sheet discharge unit 90 has a sheet discharge conveyance path 91 extending upwardly from an exit of the fixing device 80 and formed to reverse forwards, and a plurality of pairs of conveyance rollers 92 configured to convey the sheet P. The sheet P having the toner images transferred and heat-fixed thereon is conveyed along the sheet discharge conveyance path 91 and is discharged to the outside of the apparatus main body 10 by the conveyance rollers 92, so that the sheet is accumulated on the sheet discharge tray 4.

In the below, the control device 100 is described in detail.

The control device 100 has a CPU (Central Processing Unit), a ROM (Read Only Memory), a RAM (Random Access Memory) and the like, and is configured to receive a printing command and to control the feeder unit 20, the image forming unit 30, the sheet discharge unit 90 and the contact and separation mechanism 110 based on a program stored in advance.

Specifically, the control device 100 is configured to execute a printing preparation control of rotating the respective photosensitive drums 51, the respective cleaning rollers 55, the conveyance belt 73 and the like, and a printing control of applying a transfer bias to the transfer rollers 74 to transfer the toner images on the photosensitive drums 51 to the sheet P after the printing preparation control. Also, the control device 100 is configured to execute a holding control of applying a negative holding bias to the cleaning rollers 55 to hold the toners on the cleaning rollers 55 during the printing control and a cleaning control of applying a positive discharge bias to the cleaning rollers 55 and a transfer bias having an opposite polarity to the toner to the transfer rollers 74 such that the toners held on the cleaning rollers 55 are moved to the photosensitive drums 51 and the cleaning device collects the toners via the photosensitive drums 51 and the conveyance belt 73.

Specifically, during the cleaning control, the control device 100 is configured to execute a first discharge control of applying a positive discharge bias to the cleaning rollers 55 to move the toners on the cleaning rollers 55 to the photosensitive drums 51, a second discharge control of applying a negative transfer bias to the transfer rollers 74 to move the toners on the photosensitive drums 51 to the conveyance belt 73, a motor control of rotating the cleaning rollers 55, the photosensitive drums 51, the conveyance belt 73 and the various rollers in the cleaning device 10 by a motor (not shown), and a collection control of applying a collection bias between the sliding-contact roller 11 and the backup roller 15 to collect the toners on the belt into the cleaning device 10.

Figure 5:
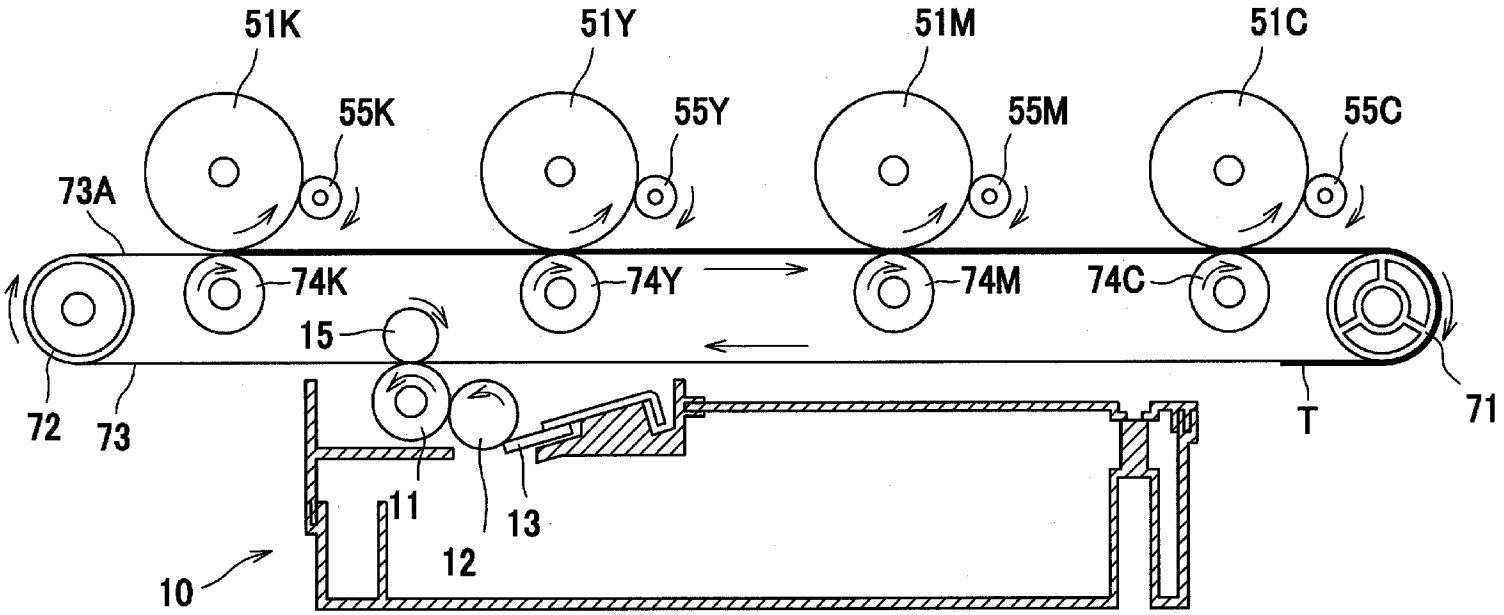
FIG. 5 shows toners on a conveyance belt when a cleaning control is suspended.

The control device 100 is configured to execute the cleaning control after the printing control and to suspend the cleaning control before the toner T1 moved to the conveyance belt 73 from the photosensitive drum 51C positioned at the most downstream side in the moving direction of the surface 73A reaches the cleaning device 10 (specifically, between the sliding-contact roller 11 and the backup roller 15), as shown in FIG. 5. Specifically, the control device 100 is configured to suspend the cleaning control just after all the toners T moved to the respective photosensitive drums 51 from the respective cleaning rollers 55 reach the conveyance belt 73 from the respective photosensitive drums 51.

Figure 6:
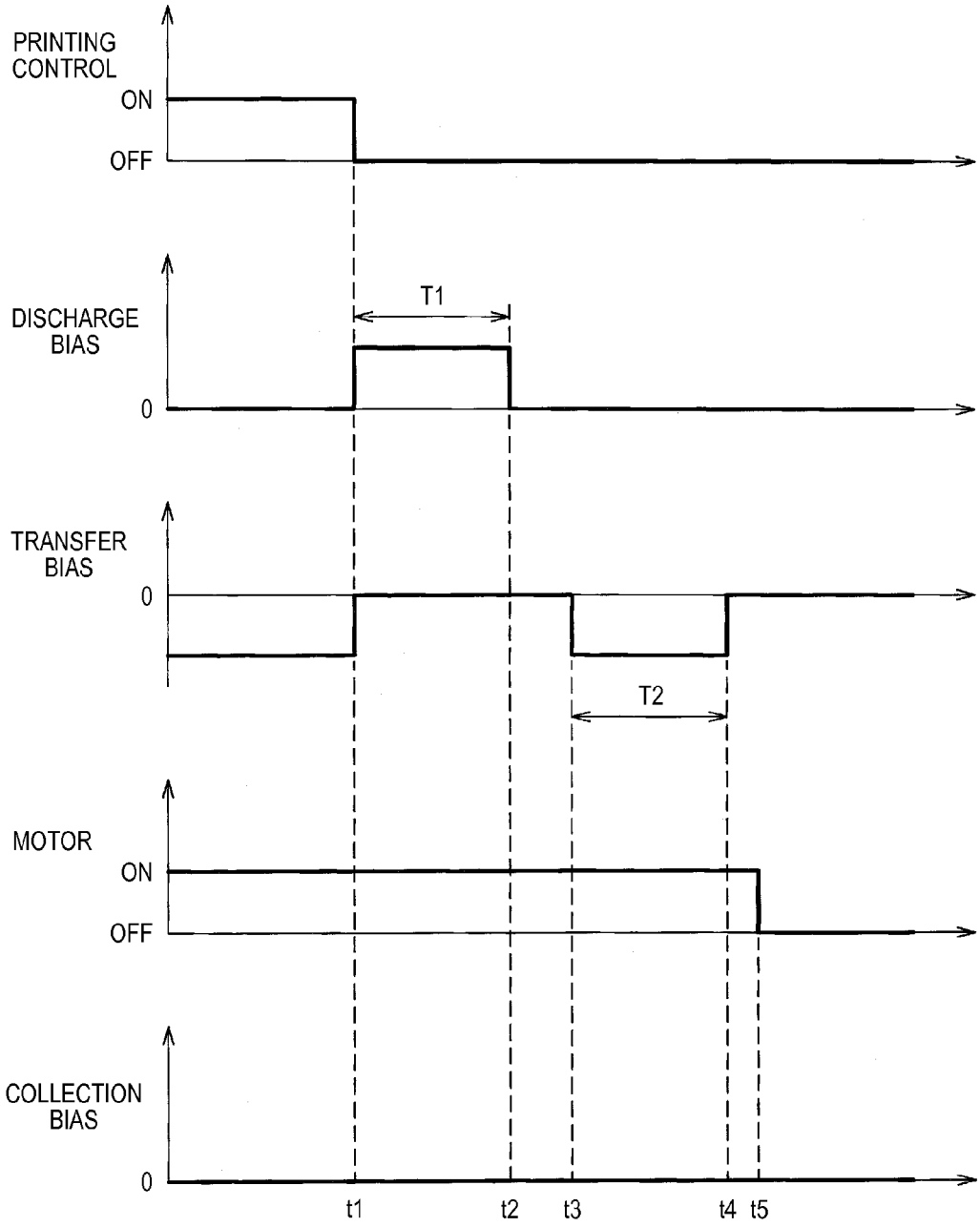
FIG. 6 is timing charts showing the first half of the cleaning control.

More specifically, as shown in FIG. 6, the control device 100 is configured to start the first discharge control after the printing control (time t1). In the first discharge control, the control device 100 is configured to apply the discharge bias to the cleaning roller 55 for a first predetermined time T1. Thereby, a predetermined amount of the toner is moved from the cleaning roller 55 to the photosensitive drum 51. In the meantime, the first predetermined time T1, and respective times, which will be described later, can be appropriately set by a test, a simulation and the like. For example, the first predetermined time T1 may be set to a time which is necessary for the cleaning roller 55 to rotate a plurality of rotations.

After the first discharge control (time t2), when the predetermined amount of the toner on the photosensitive drum 51 reaches the transfer roller 74 (time t3), the control device 100 starts the second discharge control. In the second discharge control, the control device 100 is configured to apply the transfer bias to the transfer roller 74 for a second predetermined time T2. Here, the second predetermined time T2 is set to a time which is necessary for the predetermined amount of the toner on the photosensitive drum 51 to all move to the conveyance belt 73. Thereby, the predetermined amount of the toner on the photosensitive drum 51 is all moved to the conveyance belt 73.

Incidentally, the transfer bias may be applied at the same time as the applying of the discharge bias.

After the second discharge control (time t4), the control device 100 is configured to stop the motor (the motor control is finished), thereby suspending the cleaning control (t5). In the meantime, during the first half of the cleaning control as described above, the control device 100 is configured to turn off the collection bias to be applied between the sliding-contact roller 11 and the backup roller 15. That is, during the first half of the cleaning control, the control device 100 is configured not to execute the collection control.

Figure 7:
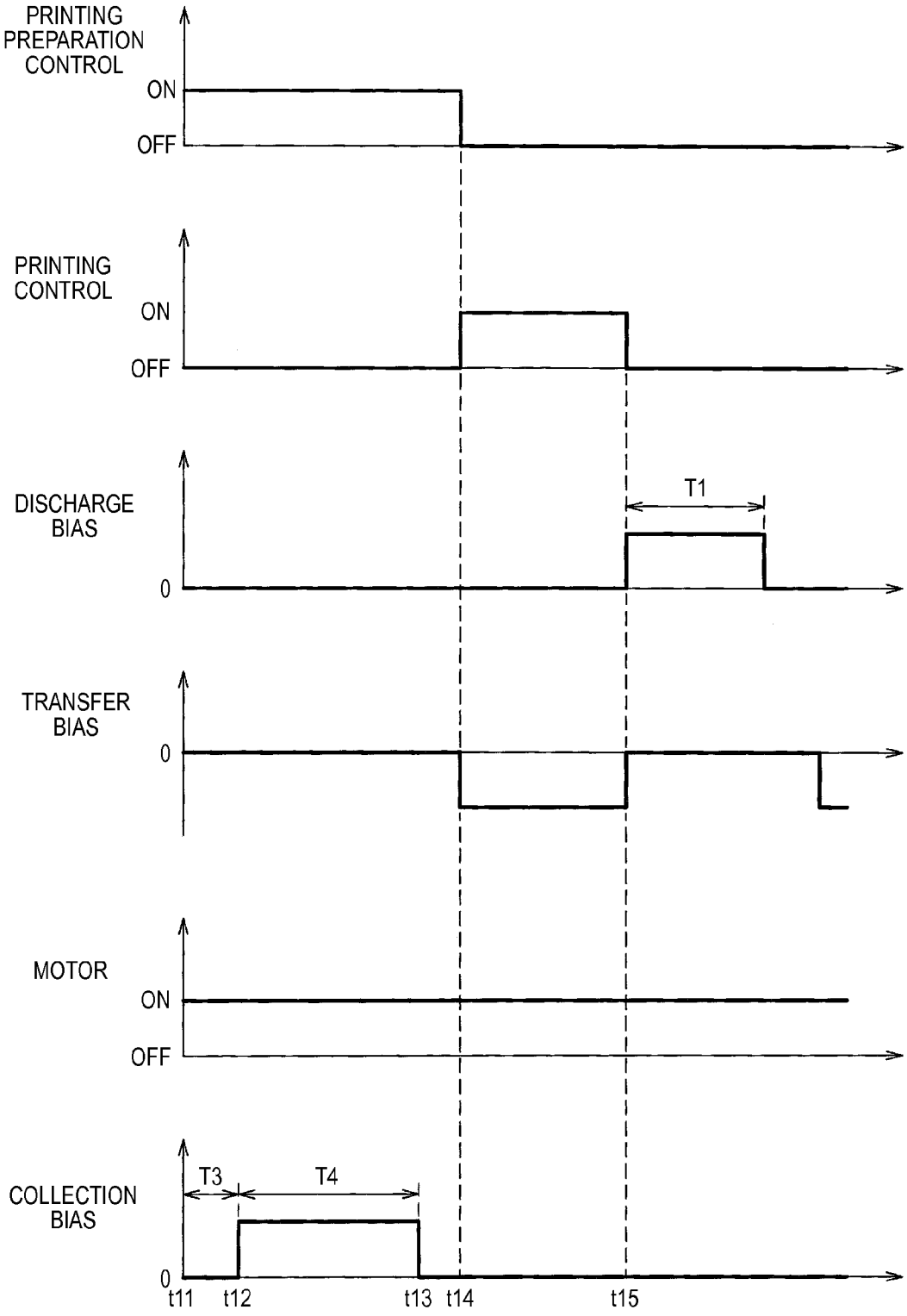
FIG. 7 is timing charts showing the second half of the cleaning control.

Further, in a case where the cleaning control is suspended, the control device 100 resumes the suspended cleaning control at a next printing preparation control or before a sleep mode is started. Specifically, as shown in FIG. 7, the control device 100 first rotates the motor by the motor control (time t11) when starting the printing preparation control. After a third predetermined time t3 elapses from the start of the motor control, the control device 100 turns on the collection bias to execute the collection control (time t12). Here, the third predetermined time T3 is set to a time or shorter after the motor starts to rotate until the toner on the conveyance belt 73 reaches the transfer roller 74. Thereby, the toner on the conveyance belt 73 is collected into the cleaning device 10.

Incidentally, the collection bias may be applied at the same time as the start of the printing preparation control.

When a fourth predetermined time T4, which is necessary to collect all the predetermined amount of the toner on the conveyance belt 73 into the cleaning device 10, elapses (time t13), the control device 100 turns off the collection bias to finish the collection control. In the meantime, after the collection control is finished, i.e., after the second half of the cleaning control is finished (time t14), the control device 100 starts the printing control, and after the printing control is finished (time t15), the control device 100 executes the first half of the cleaning control.

Figure 3:
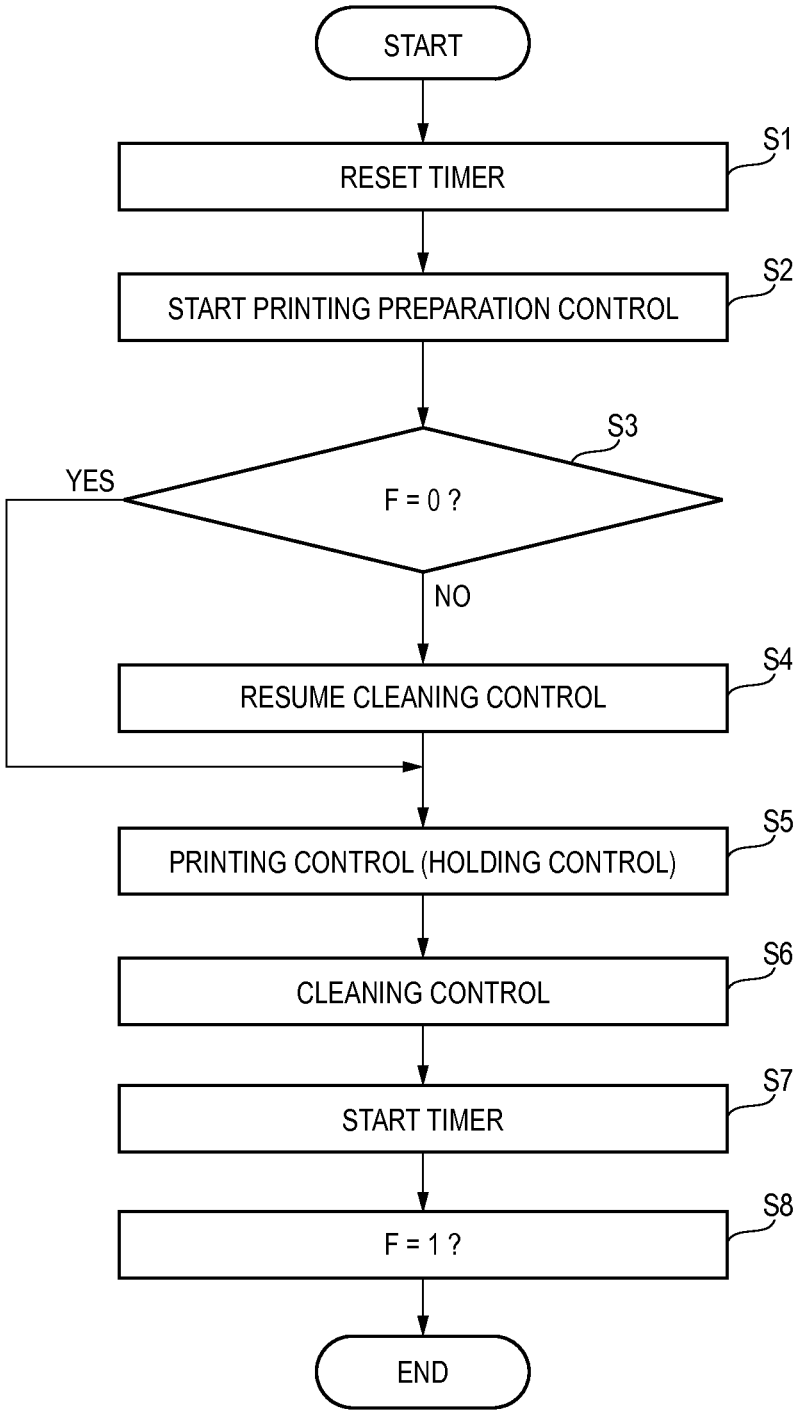
FIG. 3 is a flowchart showing an operation of a control device which is performed when a printing command is received.
Figure 4:
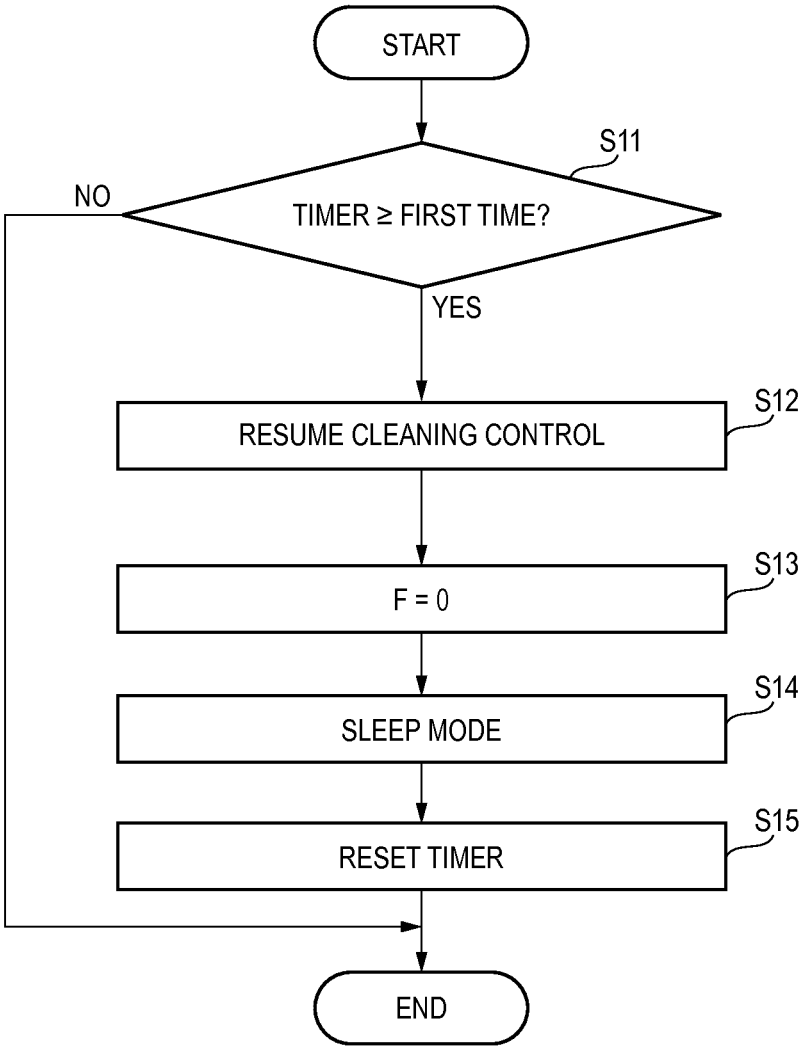
FIG. 4 is a flowchart showing an operation of the control device for executing a sleep mode.

Specifically, the control device 100 is configured to execute the control in accordance with flowcharts shown in FIGS. 3 and 4.

When a printing command is received, the control device 100 starts the control shown in FIG. 3 (START). In the meantime, the control device 100 is configured to execute the control shown in FIG. 4 all the time.

In the control of FIG. 3, the control device 100 first resets a timer (S1). Specifically, in step S1, the control device 100 returns a numerical value of the timer having started to measure time in step S7 (described later) to 0 and keeps the numerical value of the timer at 0.

After step S1, the control device 100 rotates the respective photosensitive drums 51, the respective cleaning rollers 55, the conveyance belt 73 and the like to start the printing preparation control (S2). Specifically, during the printing preparation control, the control device 100 is configured to rotate the developing rollers 53, the heating roller 81, the pressing roller 82 and the like and to heat the heating roller 81.

After step S2, the control device 100 determines whether a flag F is 0 (S3). Here, the flag F is a flag indicating whether the cleaning control is suspended. When the flag F is 1, it indicates that the cleaning control is suspended, i.e., that the toner T remains on the conveyance belt 73, and when the flag F is 0, it indicates that the cleaning control is not suspended, i.e., that the toner T does not remain on the conveyance belt 73.

When it is determined in step S3 that the flag F is not 0, i.e., that the cleaning control is suspended (No), the control device 100 resumes the cleaning control (S4). Specifically, in step S4, the control device 100 starts to apply the collection bias between the sliding-contact roller 11 and the backup roller 15 (time t12) and continues to apply the collection bias for the fourth predetermined time T4 during which the toner T remaining on the conveyance belt 73 is all collected into the cleaning device 10, as shown in FIG. 7. That is, during the printing preparation operation, the collection bias is applied to collect all the toners T remaining on the conveyance belt 73 into the cleaning device 10.

Meanwhile, in this illustrative embodiment, the collection bias is applied only in step S4. However, the present invention is not limited thereto. For example, even after the printing control starts (S5) (which will be described later), the collection bias may be continuously applied.

Also, in step S4, the control device 100 is configured not to apply the discharge bias and the transfer bias to the respective cleaning rollers 55 and the respective transfer rollers 74 (refer to FIG. 7). In this way, the bias is not applied to the respective cleaning rollers 55 and the like at the resumption of the cleaning control, so that it is possible to suppress the power consumption and to prolong the lifetime of the cleaning roller 55 and the like. In the meantime, at the resumption of the cleaning control, even when the discharge bias is not applied to the respective cleaning rollers 55, there is no problem because the toners T on the respective cleaning rollers 55 are all discharged to the conveyance belt 73 in step S6, which will be described later.

After step S4 or when a result of the determination in step S3 is Yes, the control device 100 executes the printing control and the holding control (S5).

Specifically, during the printing control, the control device 100 is configured to execute a control of light emission of the respective LED units 40 based on image data of the printing command, a control on the bias to be applied to the respective photosensitive drums 51 and the respective transfer rollers 74, a rotation control on the various rollers for conveying the sheet P, and the like.

Also, during the printing control, the control device 100 is configured to execute the holding control of applying the negative holding bias to the cleaning rollers 55 to collect and hold the toners (hereinafter, referred to as 'transfer remaining toners') remaining on the photosensitive drums 51 without being transferred to the sheet P from the photosensitive drums 51 by the cleaning rollers 55. Specifically, the control device 100 is configured to apply the holding bias to all the cleaning rollers 55 during the printing control, irrespective of the mode (monochrome or color mode) of the printing control.

In the meantime, the control device 100 may be configured not to apply the holding bias to the three cleaning rollers 55 except for the cleaning roller 55 for black when the printing control is the monochrome mode. In this case, the control device 100 may be also configured not to apply the discharge bias to the three cleaning rollers 55 except for the cleaning roller 55 for black, in the cleaning control, too.

Also, in step S5, the control device 100 starts to apply the holding bias to the respective cleaning rollers 55 and to apply the transfer bias to the respective transfer rollers 74 at the same time. Thereby, as compared to a configuration where the holding bias is applied after the transfer bias is applied, for example, it is possible to favorably collect the transfer remaining toner T on the photosensitive drum 51 by the cleaning roller 55.

When the printing control is finished, i.e., when the printing of all the sheets P in accordance with the printing command is finished, the control device 100 executes the cleaning control (S6). Specifically, during the cleaning control, the control device 100 is configured to apply the discharge bias to the respective cleaning rollers 55 and also to apply the transfer bias to the respective transfer rollers 74 while continuing to perform the rotation control on the various rollers and the conveyance belt 73, as shown in FIG. 6.

Also, when starting the cleaning control, the control device 100 starts to apply the discharge bias to the plurality of cleaning rollers 55 at the same time. Here, an amount of the toner T discharged from the cleaning roller 55 to the photosensitive drum 51 is larger in the first one rotation of the cleaning roller 55 from the start of the cleaning control than the amount discharged thereafter. For this reason, when the discharge bias is applied to the plurality of cleaning rollers 55 at the same time, like this illustrative embodiment, it is possible to prevent the higher-density parts (the parts corresponding to the first one rotation) of the toners T discharged from the respective photosensitive drums 51 to the conveyance belt 73 from overlapping with each other on the conveyance belt 73, as compared to a configuration where the discharge bias is respectively applied to the plurality of cleaning rollers at different timings, for example.

Also, during the cleaning control of step S6, since the toner T is not collected into the cleaning device 10, the collection bias is not applied to the sliding-contact roller 11 and the like, so that the power consumption is suppressed (refer to FIG. 6). In the meantime, during the cleaning control, a clutch configured to switch transmission of a driving force from the motor to the sliding-contact roller 11 and the like may be controlled not to rotate the sliding-contact roller 11 and the like, for example. However, in order to favorably rotate the conveyance belt 73, it is better to rotate at least the sliding-contact roller 11 and backup roller 15 configured to contact the conveyance belt 73.

After step S6, the control device 100 starts to measure a time by the timer (S7), sets the flag F to 1 (S8) and then finish this control.

In the control of FIG. 4, the control device 100 first determines whether the timer is equal to or longer than a first time (S11). Here, the timer is not reset unless the control device 100 receives the printing command after the cleaning control is suspended until the first time elapses (S1). Therefore, the control device 100, in fact, determines in step S11 whether the printing command is received after the cleaning control is suspended until the first time elapses.

Here, the first time is set to be slightly shorter than a time after the printing control is finished until a sleep mode is started. Incidentally, in the specification, the sleep mode means a mode in which the power feeding to the motor and the like for driving the heating roller 81 and the various rollers is OFF.

When it is determined in step S11 that the timer is less than the first time (No), the control device 100 finishes this control, and when it is determined that the timer is equal to or longer than the first time (Yes), the control device 100 resumes the cleaning control (S12). In step S12, the control device 100 executes the same processing as the processing of step S4. Specifically, the control device 100 is configured to rotate the conveyance belt 73 and the like and to apply the collection bias to the sliding-contact roller 11 and the like, thereby collecting all the toners T remaining on the conveyance belt 73 into the cleaning device 10, without applying the discharge bias and the transfer bias.

Thereby, since it is possible to resume the cleaning control before the sleep mode is started, it is possible to suppress the toners T remaining on the conveyance belt 73 from being fixed to the conveyance belt 73 during the sleep mode.

After step S12, the control device 100 returns the flag F to 0 (S13) and starts the sleep mode (S14). Incidentally, the sleep mode started in step S14 is finished when the control device 100 receives the printing command.

After step S14, the control device 100 resets the timer (S15) and finishes this control.

According to the illustrative embodiment, following effects can be achieved in addition to the above-described effects.

Since the cleaning control, which is performed after the printing control, is suspended in the middle, it is possible to shorten the time necessary to perform the cleaning control after the printing control. Also, since the second half of the cleaning control is executed at a next printing preparation control, it is possible to effectively perform the control.

Also, the cleaning control is suspended before the toner T moved from the photosensitive drum 51C positioned at the most downstream side to the conveyance belt 73 reaches the cleaning device 10. Thereby, since it is not necessary to apply the collection bias and the like to the sliding-contact roller 11 and the like during the cleaning control after the printing control, it is possible to avoid the power consumption for starting the cleaning device 10.

The cleaning control is suspended after the toners T on the respective photosensitive drums 51 are all moved to the conveyance belt 73. Therefore, it is possible to suppress the toner from being fixed to the photosensitive drum, which is caused as the attached state of the toner on the photosensitive drum continues for a long time, for example. Also, since the cleaning control is suspended just after the toners T on the respective photosensitive drums 51 are all moved to the conveyance belt 73, it is possible to shorten the time necessary to perform the cleaning control after the printing control, as compared to a configuration where the cleaning control is suspended just before the toner moved to the conveyance belt reaches the cleaning device, for example.

The discharge bias is applied to the plurality of cleaning rollers 55 at the same time at the start of the cleaning control. Thereby, since it is possible to suppress the higher-density parts (the parts corresponding to the first one rotation) of the toners T discharged from the respective photosensitive drums 51 to the conveyance belt 73 from overlapping with each other, it is possible to suppress a density difference of the toners T on the conveyance belt 73. Therefore, it is possible to favorably collect the toners T on the conveyance belt 73 into the cleaning device 10.

While the present invention has been shown and described with reference to certain illustrative embodiments thereof, it will be understood by those skilled in the art that various changes in form and details may be made therein without departing from the spirit and scope of the invention as defined by the appended claims. In the below descriptions, the members having substantially the same structures as the above illustrative embodiment are denoted with the same reference numerals and the descriptions thereof are omitted.

Figure 8:
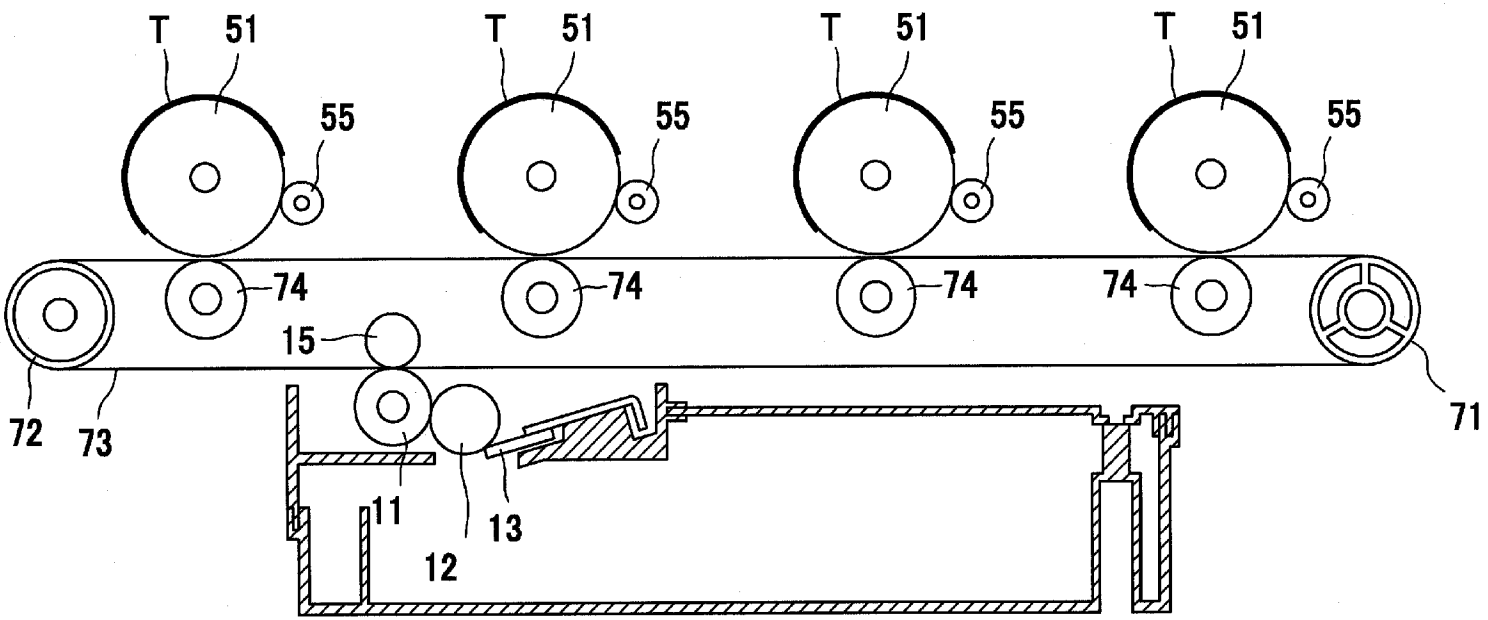
FIG. 8 is a view showing a mode in which the cleaning control is suspended at a state where the toners remain on photosensitive drums.

In the above illustrative embodiment, the cleaning control is suspended after the toners T on the respective photosensitive drums 51 are all moved to the conveyance belt 73. However, the present invention is not limited thereto. For example, as shown in FIG. 8, when the cleaning control starts, the control device 100 may suspend the cleaning control before the toners T moved from the cleaning rollers 55 to the photosensitive drums 51 reach the conveyance belt 73.

Figure 9:
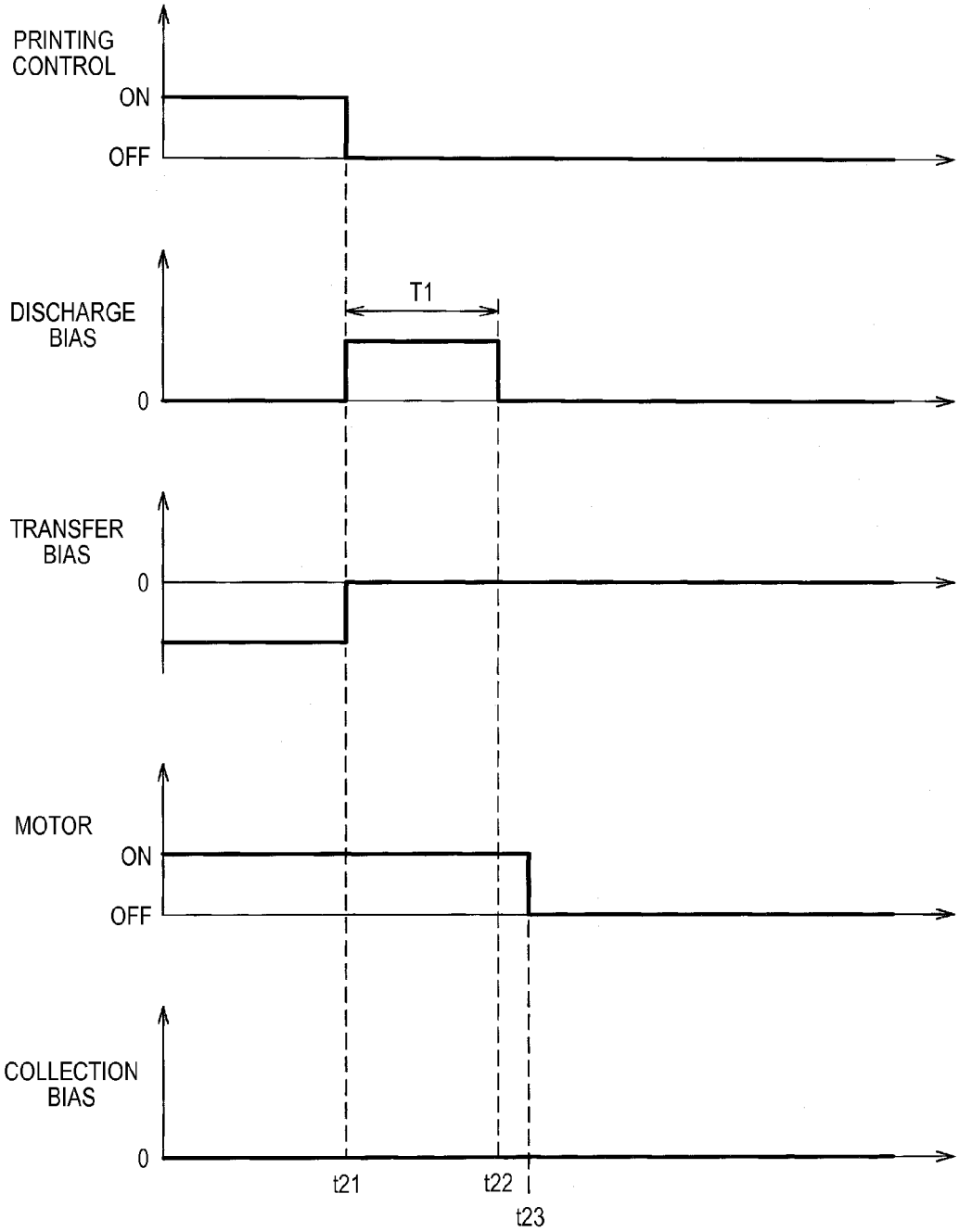
FIG. 9 is timing charts showing the first half of the cleaning control according to a modified illustrative embodiment.

In this case, as shown in FIG. 9, after the printing control (time t21), the control device 100 applies the discharge bias to the cleaning roller 55 for the first predetermined time T1 (time t22) and then stops the motor (time t23). That is, the control device 100 is configured to execute the first discharge control and the motor control during the first half of the cleaning control. Thereby, the cleaning control is suspended at a state where the toner T moved from the cleaning roller 55 to the photosensitive drum 51 remains on the photosensitive drum 51 (refer to FIG. 8).

Figure 10:
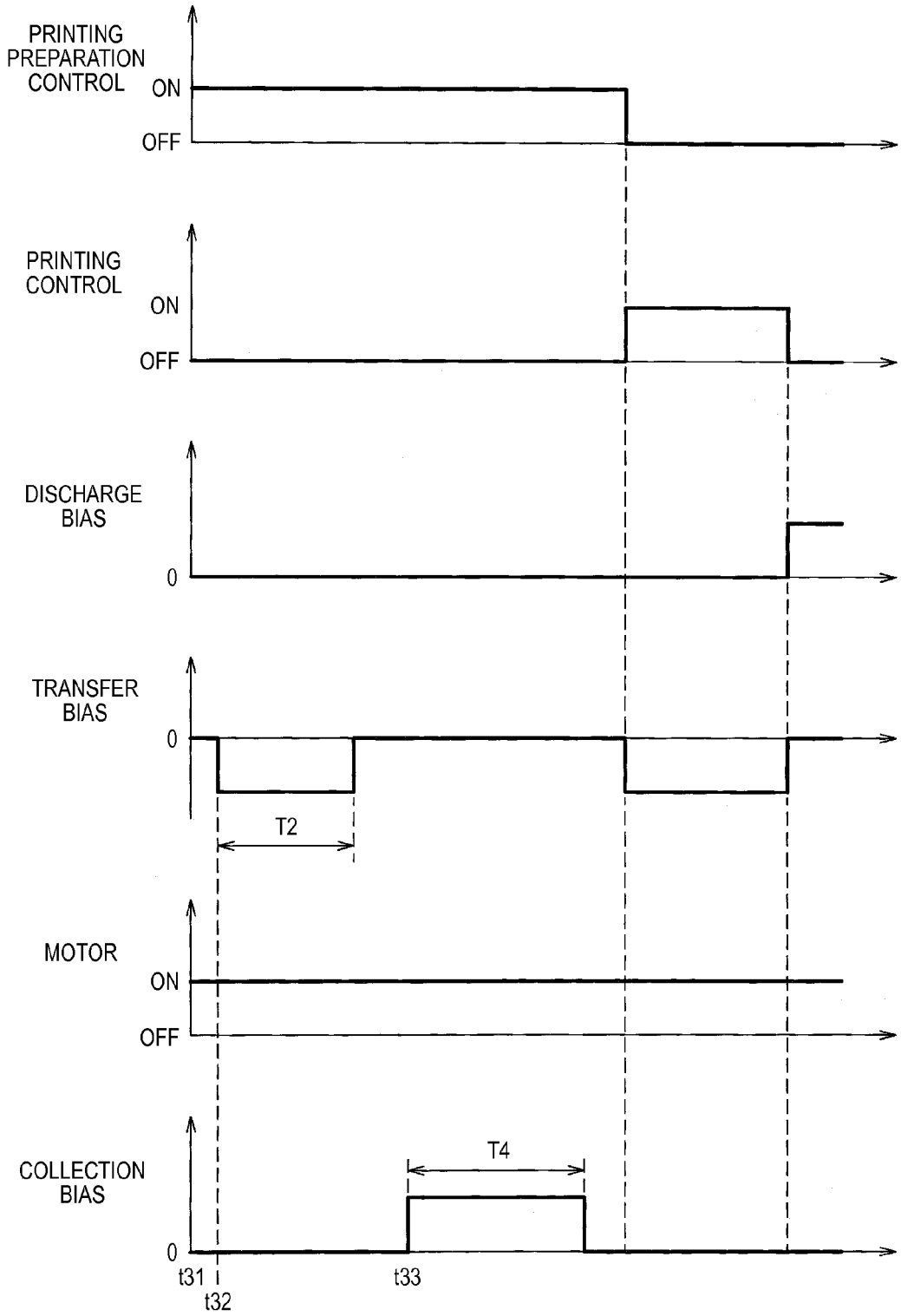
FIG. 10 is timing charts showing the second half of the cleaning control according to the modified illustrative embodiment.

Further, as shown in FIG. 10, when the control device 100 rotates the motor to start the printing preparation control (time t31), the control device 100 applies the transfer bias at a predetermined timing (time t32) for only the second predetermined time T2 and then applies the collection bias at a predetermined time (time t33) for only the fourth predetermined time T4. That is, during the second half of the cleaning control, the control device 100 is configured to execute the motor control, the second discharge control and the collection control. Thereby, the toner T remaining on the photosensitive drum 51 is moved onto the conveyance belt 73, and the toner moved onto the conveyance belt 73 is collected into the cleaning device 10.

According to this illustrative embodiment, since the cleaning control is suspended before the toner T reaches the conveyance belt 73, it is possible to further shorten the time consumed to execute the cleaning control after the printing control.

In the above illustrative embodiment, the discharge bias is applied for a constant time. However, the present invention is not limited thereto. For example, the applying time of the discharge bias may be changed depending on the amount of the toners T held on the cleaning rollers 55. Specifically, for example, during the cleaning control, the control device 100 may be configured to determine the applying time of the discharge bias in accordance with a flowchart shown in FIG. 11.

Figure 11:
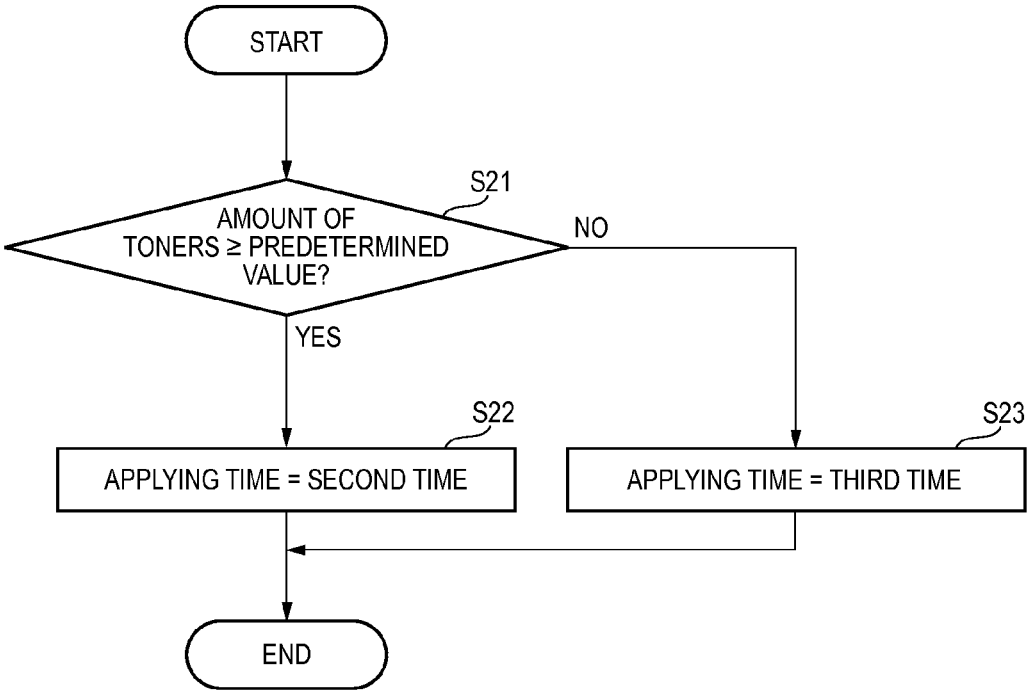
FIG. 11 is a flowchart showing a control of setting an applying time of a discharge bias.

In the control of FIG. 11, the control device 100 determines whether the amount of the toners T held on the cleaning rollers 55 is equal to or larger than a predetermined amount (S21). In the meantime, the processing of determining whether the amount of the toners T is equal to or larger than a predetermined amount may be performed by determining whether a number of printed sheets in the printing command is equal to or larger than a predetermined number of sheets or by determining whether an integrated value of printing rates in the printing command is equal to or larger than a predetermined threshold value.

When it is determined in step S21 that the amount of the toners T is equal to or larger than the predetermined amount (Yes), the control device 100 sets the applying time of the discharge bias to a second time (S22), and when it is determined that the amount of the toners is less than the predetermined amount (No), the control device 100 sets the applying time of the discharge bias to a third time shorter than second time (S23). In this way, during the cleaning control, when the amount of the toners T held on the cleaning rollers 55 is less than the predetermined amount, the applying time of the discharge bias is shortened, as compared to a case where the amount of the toners T held on the cleaning rollers 55 is equal to or larger than the predetermined amount. Accordingly, it is possible to suppress the power consumption.

In the above illustrative embodiment, the conveyance belt 73 has been exemplified as the belt for conveying the sheet P. However, the present invention is not limited thereto. For example, as shown in FIG. 12, an intermediate transfer belt 273 to which toner images are transferred from a plurality of photosensitive drums 251 may be also employed.

Figure 12:
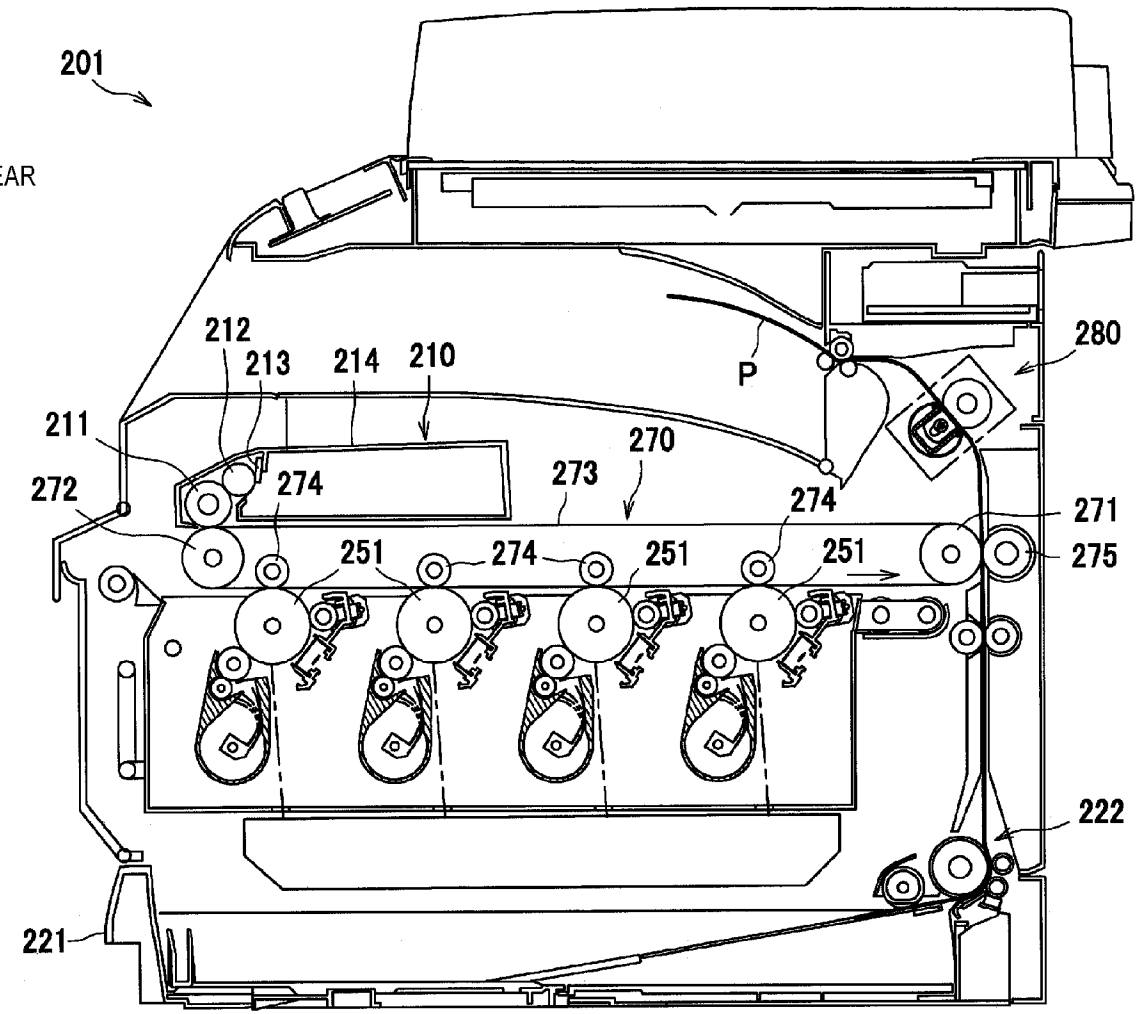
FIG. 12 is a sectional view showing a color printer having an intermediate transfer belt.

In the below, a color printer 201 shown in FIG. 12 is briefly described. The color printer 201 mainly has a plurality of photosensitive drums 251 configured to carry thereon toner images, a transfer unit 270 and a cleaning device 210 (an example of the collection device). The transfer unit 270 has an intermediate transfer belt 273 configured to contact the plurality of photosensitive drums 251, a driving roller 271 and a driven roller 272 for tensioning the intermediate transfer belt 273 therebetween, a plurality of primary transfer rollers 274 configured to interpose the intermediate transfer belt 273 between the respective photosensitive drums 251 and the primary transfer rollers 274, and a secondary transfer roller 275 configured to interpose the intermediate transfer belt 273 between the driving roller 271 and the secondary transfer roller 275.

The color printer 201 has a sheet feeding tray 221 configured to accommodate therein the sheet P, a sheet feeding mechanism 222 configured to send the sheet P in the sheet feeding tray 221 towards between the intermediate transfer belt 273 and the secondary transfer roller 275, and a fixing device 280 configured to heat-fix the toner images transferred to the sheet P between the intermediate transfer belt 273 and the secondary transfer roller 275.

The cleaning device 210 is configured to collect the toner on the intermediate transfer belt 273, and has a sliding-contact roller 211, a collection roller 212, a blade 213 and a waste toner chamber 214, which have substantially the same configurations as the above illustrative embodiment. In this configuration, the sliding-contact roller 211 of the cleaning device 210 is arranged at a position at which the sliding-contact roller 211 faces the driven roller 272 with the intermediate transfer belt 273 being interposed therebetween. Thereby, a distance from the photosensitive drum 251 positioned at the most downstream side to the cleaning device 210 is longer than the above illustrative embodiment.

In the configuration where the distance from the photosensitive drum 251 positioned at the most downstream side to the cleaning device 210 is very long, it takes much time to collect the toner into the cleaning device during the cleaning control after the printing control. However, when the inventive concept of the present invention is applied to this configuration, it is possible to shorten the time necessary to execute the cleaning control after the printing control, so that the present invention is particularly efficient.

In the above illustrative embodiment, the cleaning roller 55 has been exemplified as the holding roller. However, the present invention is not limited thereto. For example, the holding roller may be a brush-shaped member configured to sliding-contact the photosensitive drum and to collect the toner on the photosensitive drum, the charging roller configured to contact the photosensitive drum and to charge the same, and the like.

In the above illustrative embodiment, the cleaning device 10 having the sliding-contact roller 11 configured to contact the conveyance belt 73, and the like has been exemplified as the collection device. However, the present invention is not limited thereto. For example, the collection device may be a device having a blade configured to sliding-contact the belt.

In the above illustrative embodiment, the photosensitive drum 51 has been exemplified as the image carrier. However, the present invention is not limited thereto. For example, the image carrier may be a belt-type photosensitive member.

In the above illustrative embodiment, the toner having the positive polarity has been exemplified as the developer. However, the present invention is not limited thereto. For example, the developer may be toner having a negative polarity. In the meantime, when the toner having a negative polarity is used, the holding bias, the discharge bias and the like may have an opposite polarity to the illustrative embodiment.

In the above illustrative embodiment, the present invention has been applied to the color printer 1. However, the present invention is not limited thereto. For example, the present invention can be also applied to the other image forming apparatus such as a copier, a complex machine and the like.

In the above illustrative embodiment, the transfer roller 74 has been exemplified as the transfer member. However, the present invention is not limited thereto. For example, the transfer member may be any member to which the transfer bias is applied, such as a conductive brush and a conductive plate spring.

In the above illustrative embodiment, the sheet P such as a cardboard, a postcard, a thin sheet and the like has been exemplified as the sheet. However, the present invention is not limited thereto. For example, the sheet may be an OHP sheet.

What is claimed is:

1. An image forming apparatus comprising:

a plurality of image carriers configured to carry thereon developer images, respectively;

a plurality of holding rollers provided to correspond to the plurality of image carriers and configured to hold developer attached on the respective image carriers;

a rotatable endless belt having a surface configured to contact the plurality of image carriers and configured to move in a moving direction;

a plurality of transfer members provided to interpose the belt between the respective image carriers and the respective transfer members and configured to transfer the developer on the respective image carriers to the belt;

a collection device configured to contact the belt and to collect the developer on the belt; and a control device configured to execute a printing preparation control of rotating the respective image carriers, the respective holding rollers and the belt, a printing control of transferring the developer images on the image carriers to a sheet after the printing preparation control, a holding control of applying to the holding rollers a holding bias having a polarity opposite to the developer during the printing control such that the holding rollers hold the developer on the image carriers, and a cleaning control of applying to the holding rollers a discharge bias having a polarity same as the developer and applying to the transfer members a transfer bias having a polarity opposite to the developer such that the developer held on the holding rollers is moved to the image carriers and the collection device collects the developer via the image carriers and the belt, wherein the control device is configured to:

start the cleaning control after the printing control, suspend the cleaning control before the developer moved to one of the image carriers from one of the holding rollers positioned at a most downstream side in the moving direction reaches the collection device, and resume the suspended cleaning control at a next printing preparation control.

2. The image forming apparatus according to claim 1, wherein in the cleaning control, the control device is configured to suspend the cleaning control before the developer moved from the respective holding rollers to the respective image carriers reaches the belt.

3. The image forming apparatus according to claim 1, wherein in the cleaning control, the control device is configured to suspend the cleaning control after all the developer moved from the respective holding rollers to the respective image carriers reaches the belt from the image carriers.

4. The image forming apparatus according to claim 1, wherein the control device is configured to apply the holding bias to the holding rollers and to apply the transfer bias to the transfer members at a same time.

5. The image forming apparatus according to claim 1, wherein when a printing command is not received until a first time elapses after the cleaning control is suspended, the control device is configured to resume the cleaning control.

6. The image forming apparatus according to claim 5, wherein when the printing command is not received until the first time elapses after the cleaning control is suspended, the control device is configured to resume the cleaning control and execute a sleep mode after the cleaning control is finished.

7. The image forming apparatus according to claim 1, wherein when resuming the cleaning control, the control device is configured not to apply the holding bias and the discharge bias to the holding rollers.

8. The image forming apparatus according to claim 1, wherein a circumferential speed of the holding rollers is faster than a circumferential speed of the image carriers.

9. The image forming apparatus according to claim 1, wherein in the cleaning control, the control device is configured to start to apply the discharge bias to the holding rollers at a same time.

10. The image forming apparatus according to claim 1, wherein in the cleaning control, the control device is configured to:

when an amount of the developer held on the holding rollers is equal to or larger than a predetermined amount, set an applying time of the discharge bias to a second time, and when the amount of the developer held on the holding rollers is less than the predetermined amount, set the applying time of the discharge bias to a third time shorter than second time.

11. The image forming apparatus according to claim 1, wherein the belt is an intermediate transfer belt to which the developer images are transferred from the respective image carriers.

12. The image forming apparatus according to claim 1, wherein the control device is configured to stop rotations of the respective holding rollers and the belt when the cleaning control is suspended.

13. A control method for an image forming apparatus including a plurality of image carriers configured to carry thereon developer images, respectively, a plurality of holding rollers provided to correspond to the plurality of image carriers and configured to hold developer attached on the respective image carriers, a rotatable endless belt having a surface configured to contact the plurality of image carriers and configured to move in a moving direction, a plurality of transfer members provided to interpose the belt between the respective image carriers and the respective transfer members and configured to transfer the developer on the respective image carriers to the belt, and a collection device configured to contact the belt and to collect the developer on the belt, the control method comprising:

executing a printing preparation control of rotating the respective image carriers, the respective holding rollers and the belt;

executing a printing control of transferring the developer images on the image carriers to a sheet after the printing preparation control;

executing a holding control of applying to the holding rollers a holding bias having a polarity opposite to the developer during the printing control such that the holding rollers hold the developer on the image carriers; and executing a cleaning control of applying to the holding rollers a discharge bias having a polarity same as the developer and applying to the transfer members a transfer bias having a polarity opposite to the developer such that the developer held on the holding rollers is moved to the image carriers and the collection device collects the developer via the image carriers and the belt, wherein the control method comprises:

starting the cleaning control after the printing control;

suspending the cleaning control before the developer moved to one of the image carriers from one of the holding rollers positioned at a most downstream side in the moving direction reaches the collection device; and resuming the suspended cleaning control at a next printing preparation control.

14. The control method according to claim 13, wherein the suspending suspends the cleaning control before the developer moved from the respective holding rollers to the respective image carriers reaches the belt.

15. The control method according to claim 13, wherein the suspending suspends the cleaning control after all the developer moved from the respective holding rollers to the respective image carriers reaches the belt from the image carriers.

16. The control method according to claim 13, wherein the cleaning control applies the holding bias to holding rollers and applies the transfer bias to the transfer members at a same time.

17. The control method according to claim 13, further comprising:

resuming the suspended cleaning control when a printing command is not received until a first time elapses after the cleaning control is suspended.

18. The control method according to claim 13, further comprising:

resuming the suspended cleaning control when a printing command is not received until a first time elapses after the cleaning control is suspended; and executing a sleep mode after the cleaning control is finished.

19. The control method according to claim 13, wherein when resuming the cleaning control, the holding bias and the discharge bias are not applied to the holding rollers.

20. The control method according to claim 13, further comprising:

stopping rotations of the respective holding rollers and the belt when the cleaning control is suspended.

* * * * *